US010807821B2

(12) United States Patent
Iida

(10) Patent No.: US 10,807,821 B2
(45) Date of Patent: Oct. 20, 2020

(54) FILM SUPPLYING DEVICE IN HORIZONTAL PACKAGE MAKING AND FILLING MACHINE

(71) Applicant: Fuji Machinery Co., Ltd., Nagoya-shi, Aichi (JP)

(72) Inventor: Takeo Iida, Nagoya (JP)

(73) Assignee: Fuji Machinery Co., Ltd., Nagoya-Shi, Aichi (JP)

( * ) Notice: Subject to any disclaimer, the term of this patent is extended or adjusted under 35 U.S.C. 154(b) by 400 days.

(21) Appl. No.: 15/719,264

(22) Filed: Sep. 28, 2017

(65) Prior Publication Data

US 2018/0086582 A1 Mar. 29, 2018

(30) Foreign Application Priority Data

Sep. 29, 2016 (JP) ..... 2016-191919

(51) Int. Cl.
*B65H 20/02* (2006.01)
*B65B 9/06* (2012.01)
(Continued)

(52) U.S. Cl.
CPC ..... *B65H 20/02* (2013.01); *B65B 9/06* (2013.01); *B65B 35/24* (2013.01); *B65B 41/16* (2013.01);
(Continued)

(58) Field of Classification Search
CPC ..... B65H 20/02; B65H 2801/69; B65H 2404/143; B65H 2701/1752; B65H 2301/512145; B65H 2301/522; B65H 2404/144; B65B 35/24; B65B 41/16; B65B 9/06
See application file for complete search history.

(56) References Cited

U.S. PATENT DOCUMENTS 5,463,842 A * 11/1995 Lancaster ..... B65B 11/045 53/389.4
5,875,616 A * 3/1999 Paavola ..... B65B 11/025 425/66
(Continued)

FOREIGN PATENT DOCUMENTS

JP H07-002415 A 1/1995
JP 2001-247105 A 9/2001
(Continued)

OTHER PUBLICATIONS

Japanese Office Action dated Feb. 26, 2019 issued in corresponding Japanese Application No. 2016-191919.

*Primary Examiner* — William A. Rivera
(74) *Attorney, Agent, or Firm* — Norton Rose Fulbright US LLP

(57) ABSTRACT

In a film supplying device in a package machine, a film drawn out from a film roll is fed downstream between a drive roll and a driven roll. The drive roll is rotatably supported by a first support fixed to a main frame. A second support for rotatably supporting the driven roll is supported on the main frame so as to be rotatable. The second support is movable between a sandwiched position where the driven roll approaches the drive roll to be aligned therewith to hold the film therebetween, and a retract position in which the driven roll is spaced apart from the drive roll.

13 Claims, 4 Drawing Sheets

(51) Int. Cl.
*B65B 41/16* (2006.01)
*B65B 35/24* (2006.01)

(52) U.S. Cl.
CPC ..... *B65H 2301/512145* (2013.01); *B65H 2301/522* (2013.01); *B65H 2404/143* (2013.01); *B65H 2404/144* (2013.01); *B65H 2701/1752* (2013.01); *B65H 2801/69* (2013.01)

(56) References Cited

U.S. PATENT DOCUMENTS

| | | | | |
|---|---|---|---|---|
| 6,296,402 | B1 * | 10/2001 | Yamamoto | B65H 19/10 396/599 |
| 2007/0204564 | A1 * | 9/2007 | Lancaster, III | B65B 11/006 53/399 |
| 2009/0120307 | A1 * | 5/2009 | Koskela | B65B 11/025 100/27 |
| 2011/0146203 | A1 * | 6/2011 | Lancaster, III | B65B 11/006 53/220 |
| 2012/0124944 | A1 * | 5/2012 | Lancaster, III | B65B 11/006 53/441 |
| 2018/0079543 | A1 * | 3/2018 | Ravizza | B65B 41/16 |

FOREIGN PATENT DOCUMENTS

| | | | |
|---|---|---|---|
| JP | 2003-267601 | A | 9/2003 |
| JP | P3721534 | | 11/2005 |
| JP | 2015-174683 | A | 10/2015 |
| JP | 2016-098014 | A | 5/2016 |

* cited by examiner

FILM SUPPLYING DEVICE IN HORIZONTAL PACKAGE MAKING AND FILLING MACHINE

TECHNICAL FIELD

The present invention relates to a film supplying device in a horizontal package making and filling machine, which includes a pair of rolls for drawing a film from a film roll.

BACKGROUND ART

A horizontal package making and filling machine has been widely put to practical use that, while feeding a belt-like film (hereinafter referred to as film), overlaps widthwise both end edges of the film with each other to form a tubular shape, and applies a longitudinal seal to the overlapped part along the feeding direction of the tubular film, and applies lateral seals to the film at the front and rear of articles, filled in the tubular film at predetermined intervals, along a direction crossing the feeding direction of the tubular film. A known way of this horizontal package making and filling machine includes a feed roll composed of a drive roll and a driven roll, which is provided in a film feed course between the film roll and a package former, and draws a film from the film roll by way of the feed roll (for example, refer to Patent Document 1).

RELATED ART LITERATURE

Patent Document

Patent Document 1: Japanese Patent No. 3721534

SUMMARY OF THE INVENTION

Problem to be Solved by the Invention

The feed roll disclosed in Patent Document 1 is configured to support both ends of each roll by a frame in order to keep the rolls parallel to each other, so that the force received by the film from the feed roll becomes uniform in the width direction of the films to prevent deviation of the film. For a preparatory operation for packaging in the horizontal package making and filling machine, an operator winds the film drawn from the film roll on various rolls along a predetermined course, and then sets the film to the package former. For this setting operation, the film supplying device provided with the feed roll includes an open-and-close mechanism provided between the drive roll and the driven roll to separate the rolls from each other so as to pass the film therebetween.

As the open-and-close mechanism, an eccentric mechanism is adopted in which a shaft on which a driven roll is rotatably supported is rotatably provided on both frames via an eccentric holder to which the shaft is eccentrically connected, and an operation lever provided on the eccentric holder is turned to eccentrically move the shaft to thereby separate the driven roll from the drive roll. The film setting operation is carried out by the operator by separating both rolls to pass the leading end of the film through openings (holes) formed by both rolls and both frames, and then setting the film on a guide roll, a package former, or the like provided downstream of the openings in the film feed course.

In such a film setting operation, an operation of drawing the film from the heavy film roll requires a large force. In addition, since the width by which both rolls can be separated by the eccentric mechanism is narrow, the film is drawn out by a slightly excess amount from the roll beforehand, and the leading end of the film is passed through the narrow openings to avoid simultaneous execution of an operation requiring delicacy and an operation requiring force. However, an operator who is unfamiliar with such a setting operation may draw the film too much in the film setting operation, and have a trouble in handling the film when passing the leading end of the film through the narrow openings. Also, care should be taken not to damage the film that is drawn out much, thus lowering the operating efficiency. That is, the time required for the film setting operation varies depending on the skills of the operators, which may interfere with the efficient production.

The present invention has been made and proposed in consideration of, and to solve, the above-mentioned problems of the related art, and provides a film supplying device in a horizontal package making and filling machine that can increase the efficiency of an operation of setting a film.

Means for Solving the Problem

To solve the problem and achieve the desired purpose, a film supplying device in a horizontal package making and filling machine according to a first aspect of the invention set forth in claim 1 is a film supplying device in a horizontal package making and filling machine provided with an approaching angle adjusting device adjusting an approaching angle of a film toward a tube former, the approaching angle adjusting device being provided in a film feed course between a film roll and the tube former, the film supplying device comprising:

- a drive side rotation member provided in the film feed course between the film roll and the approaching angle adjusting device, and extending along a width direction of the film;
- a driven side rotation member that rotates responsive to the drive side rotation member with the film being sandwiched between the drive side rotation member and the driven side rotation member;
- a first support member fixed to a main body and supporting the drive side rotation member rotatably on both sides in a rotational axial direction of the drive side rotation member; and
- a second support member rotatably supporting the driven side rotation member on both sides in the rotational axial direction of the driven side rotation member,
- wherein the second support member is supported on the main body in such a way as to be movable between a sandwiched position in which the driven side rotation member approaches the drive side rotation member to be aligned therewith to sandwich the film, and a retract position spaced apart from the sandwiched position, and
- the drive side rotation member that moves the second support member to the sandwiched position to sandwich the film with the driven side rotation member is rotated to draw the film downstream from the film roll.

According to the first aspect of the invention set forth in claim 1, the second support member that supports the drive side rotation member is configured to be movable between the sandwiched position in which the driven side rotation member approaches the drive side rotation member supported on the first support member, and the retract position spaced apart therefrom, so that the driven side rotation member and the drive side rotation member may be greatly spaced apart from each other to facilitate a film setting operation.

That is, it is possible to eliminate a troublesome delicate operation of passing the leading end of the film through a narrow opening, which may improve the operability of setting the film, and prevent the production efficiency from varying depending on the skills of the operators. In addition, the drive side rotation member is configured to be supported on the first support member fixed to the main body, so that the structure of coupling the drive system to the drive side rotation member may be simplified.

According to a second aspect of the invention set forth in claim 2, the drive side rotation member is supported on the first support member so that a rotational axis of the drive side rotation member extends along a horizontal direction, and the driven side rotation member is supported on the second support member so that the rotational axis of the driven side rotation member extends along the horizontal direction, and the second support member is supported on the main body so as to be horizontally movable between the sandwiched position in which the driven side rotation member is horizontally arranged with the drive side rotation member, and the retract position.

According to the second aspect of the invention set forth in claim 2, the second support member is configured to be horizontally movable, so that the operator need not hold the second support member moved to the retract position, ensuring a proper operability.

According to a third aspect of the invention set forth in claim 3, the film which is drawn from the film roll is wound on the drive side rotation member from a side, and the film sandwiched by the drive side rotation member and the driven side rotation member is fed out upward and downward, and the second support member is provided with a cover to cover a facing region of the drive side rotation member and the driven side rotation member from above in the sandwiched position.

According to the third aspect of the invention set forth in claim 3, the cover that covers the upper side of the facing region of the drive side rotation member and the driven side rotation member in the sandwiched position is provided in the second support member, making it possible to prevent a foreign matter or the like from entering the facing region during a packaging operation. In addition, since the cover is also separated from the upper side of the facing region by moving the second support member at the time of setting the film, the cover does not interfere with the film setting operation to smoothly proceed with the film setting operation.

According to a fourth aspect of the invention set forth in claim 4, the film sandwiched by the drive side rotation member and the driven side rotation member is fed out downstream.

According to the fourth aspect of the invention set forth in claim 4, even when an operator releases hands with the film wound on the drive side rotation member during the film setting operation, the film does not come off the drive side rotation member, resulting in an improved operability.

Effect of the Invention

The film supplying device in a horizontal package making and filling machine according to the present invention may enhance the operability of the film setting operation to improve the production efficiency.

MODE FOR CARRYING OUT THE INVENTION

Next, a film supplying device in a horizontal package making and filling machine according to the invention is described with reference to the accompanying drawings by raising the preferred embodiment.

Embodiment

Figure 1:
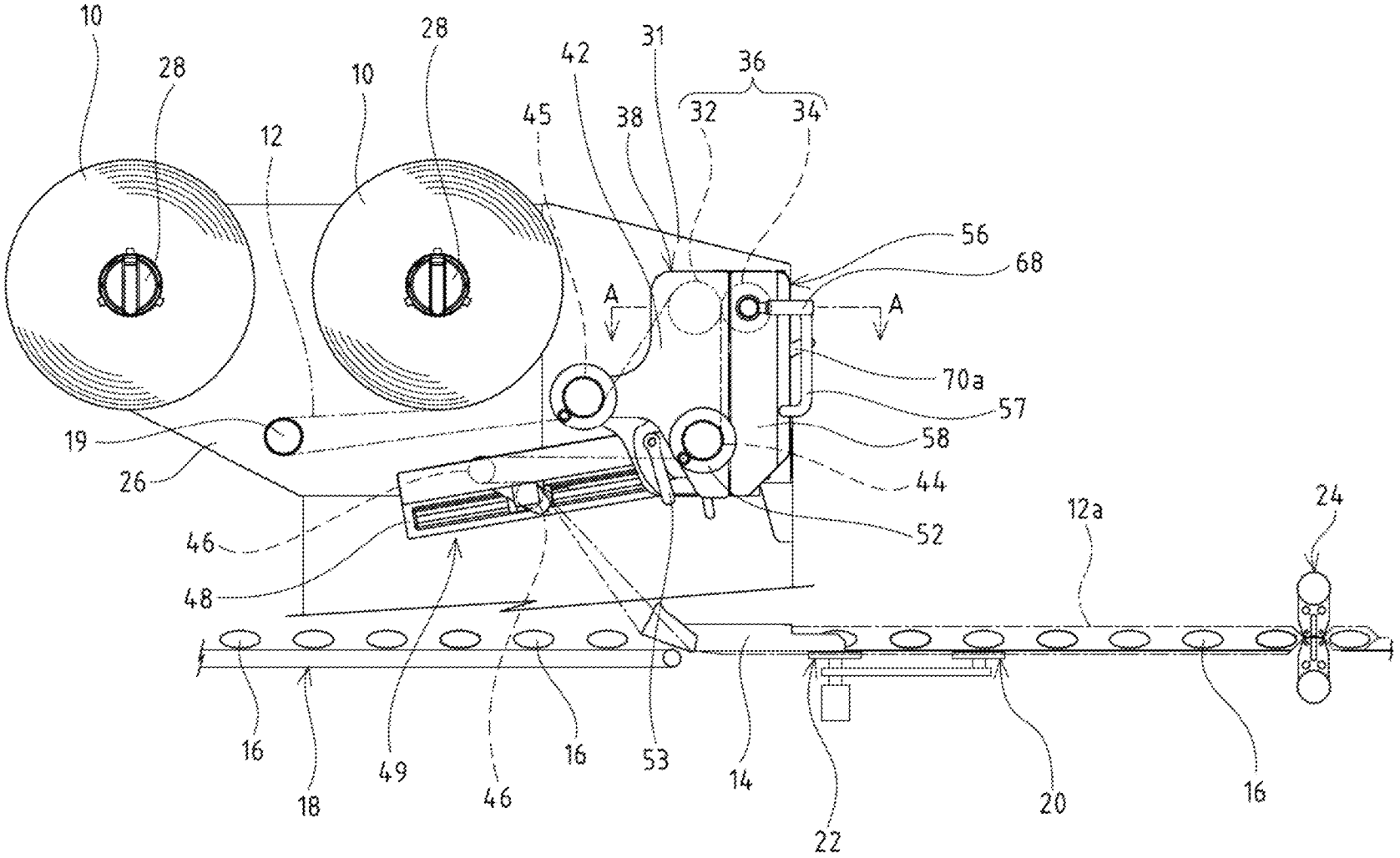
FIG. 1 A schematic side view illustrating a horizontal package making and filling machine using a film supplying device according to an embodiment of the invention.

FIG. 1 illustrates a horizontal package making and filling machine provided with a film supplying device according to an embodiment. The horizontal package making and filling machine includes tube former 14 for overlapping both widthwise end edges of a film 12, drawn from a film roll 10, in a folded shape to form a tubular film 12*a*, a supply conveyor 18 for supplying articles 16 toward the tubular film 12*a* at predetermined intervals, longitudinal seal device 20 for applying a longitudinal seal to the overlapped portion of the tubular film 12*a* overlapped in the folded shape, film conveying device 22 for holding the overlapped portion of the tubular film 12*a*, and conveying the tubular film 12*a* toward the longitudinal seal device 20, and lateral seal device 24 for holding the tubular film 12*a* at the front and rear positions of the articles 16 supplied inside the tubular film 12*a*, and applying a lateral seal to the tubular film 12*a* in a direction crossing the conveying direction of the tubular film 12*a*. The horizontal package making and filling machine also includes approaching angle adjusting device 49 for adjusting the approaching angle of the film 12 directed toward the tube former 14 in the film feed course between the film roll 10 and the tube former 14, and has a film supplying device provided in the film feed course between the film roll 10 and the approaching angle adjusting device 49 for feeding the film 12, drawn from the film roll 10, toward the tube former 14.

Figure 2:
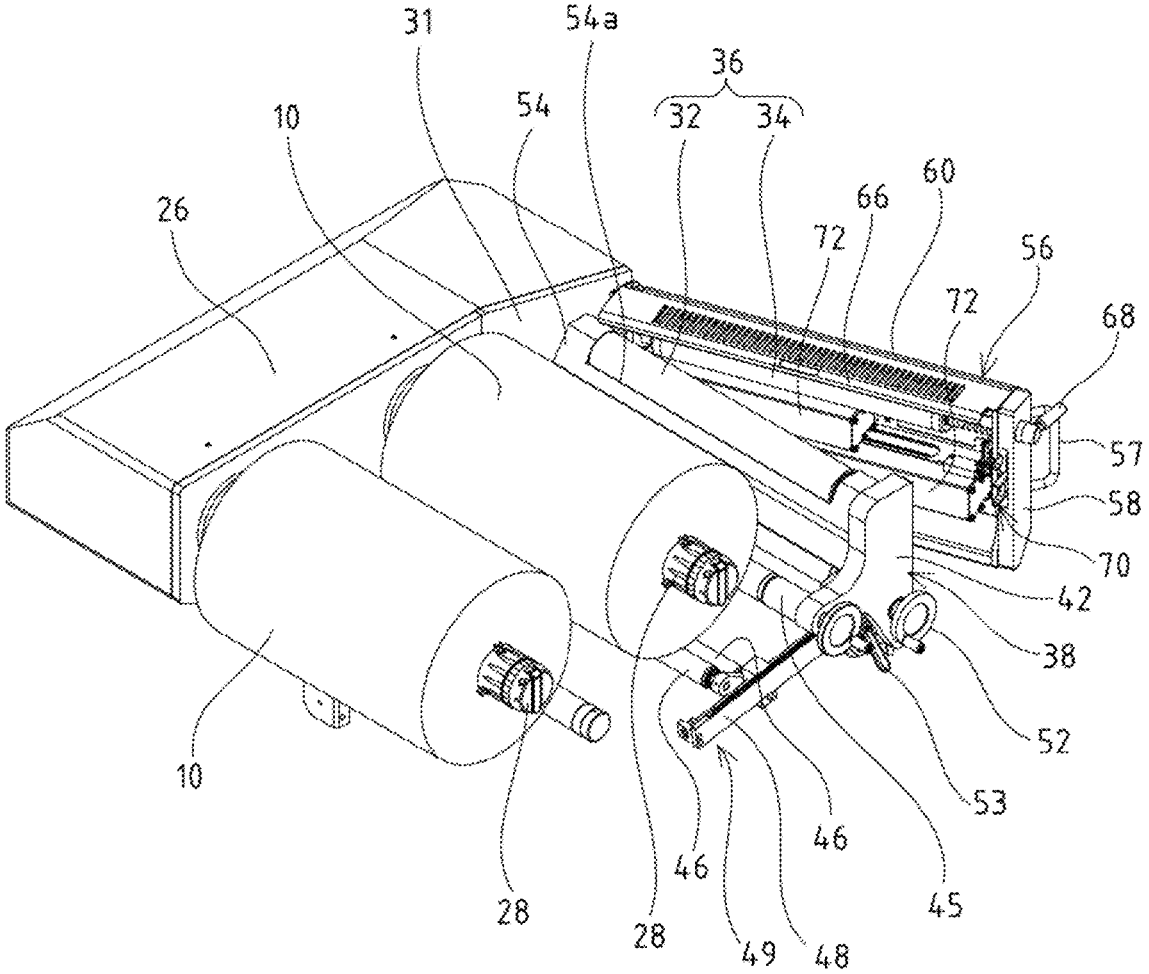
FIG. 2 A schematic perspective view illustrating a state where a second support in the film supplying device according to the embodiment is moved to a retract position.
Figure 3:
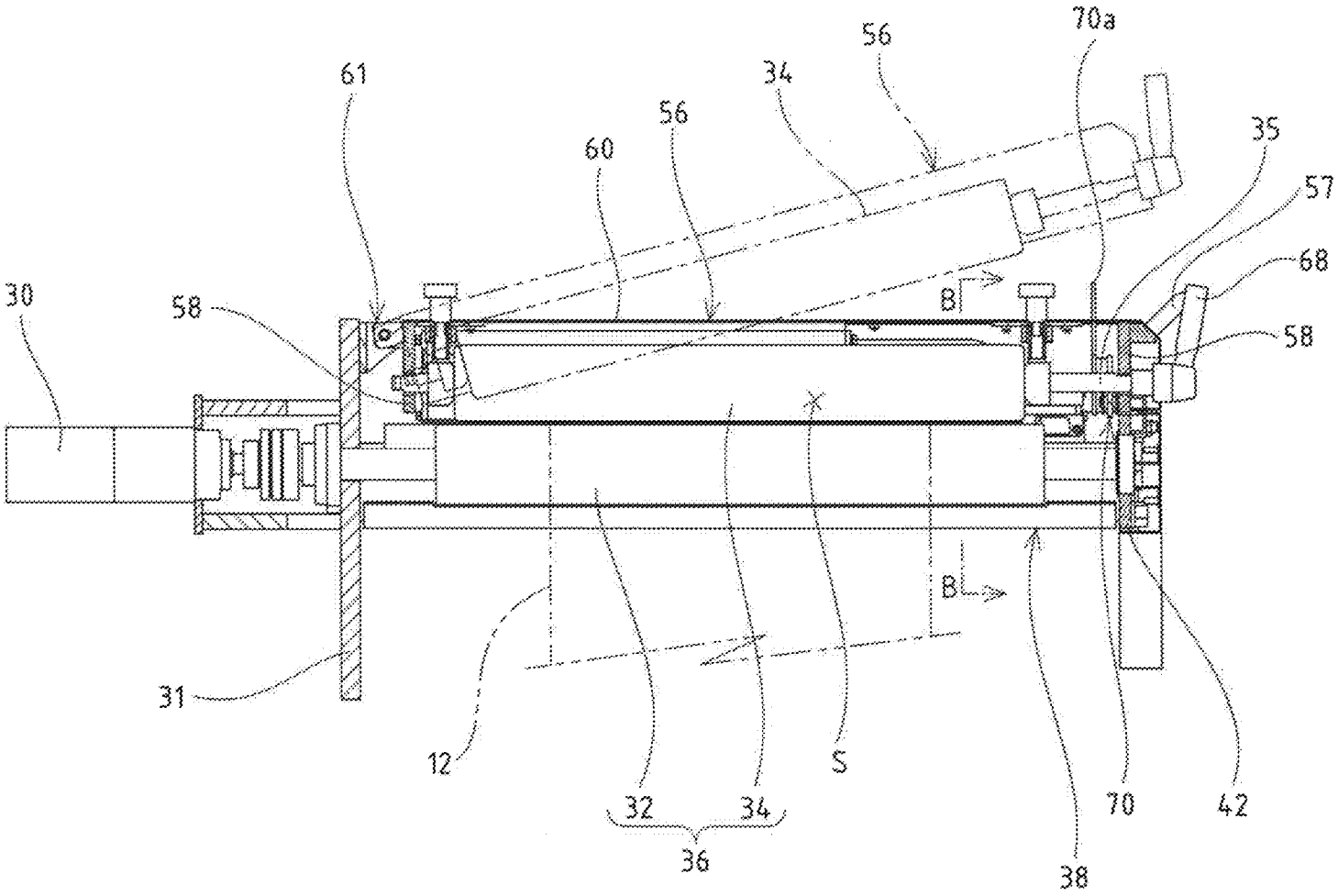
FIG. 3 A schematic cross-sectional view taken along line A-A in FIG. 1 of the film supplying device according to the embodiment.

The supply conveyor 18, the tube former 14, and the like are disposed on the front side of a main frame 26 (part of which is shown in FIGS. 1 and 2) constituting the frame of the horizontal package making and filling machine, where an operator performs a drive operation, a film setting operation, and so forth. A plurality of (two in the embodiment) loading shafts 28 to which the film roll 10 is rotatably loaded are cantilever-supported on the main frame 26 so as to extend horizontally toward the front side above the supply conveyor 18 (see FIG. 2). Further, the film supplying device and the approaching angle adjusting device 49 are disposed on the main frame 26 at positions spaced apart rightward from the loading shaft 28 located on the right side (the side approaching the lateral seal device 24) in FIG. 1, and between the film roll 10 and the tube former 14 at the height position. As shown in FIG. 3, the film supplying device includes a feed roll 36 composed of a drive roll 32 as drive side rotation member, which is rotated by a drive motor 30 such as a servomotor, and a driven roll 34 as driven side rotation member, which may hold the film 12 with the drive roll 32, and also includes a first support 38 and a second support 56. While the surface of the drive roll 32 is metal, the driven roll 34 is composed of a rubber roll whose surface is made of a rubber material. With the film 12 being sandwiched between the drive roll 32 extending along the width direction of the film 12 and the driven roll 34 moved to a sandwiched position to be described later, the driven roll 34 is driven responsive to the rotation of the drive roll 32 to draw out the film 12 from the film roll 10 and deliver the film 12 downstream.

The first support (first support member) 38 includes a fixed panel 31 fixed to the main frame 26, a reinforcing stay 40 (see FIG. 4) extending frontward along the axis of the drive roll 32 rotatably supported by the fixed panel 31, and a sub frame 42 connected to the extending end of the reinforcing stay 40. The drive roll 32 has one end directed to the back side and inserted into a hole formed in the fixed panel 31 to be drivingly connected to a drive motor 30 such as a servo motor fixed to the back surface of the fixed panel 31. The other end of the drive roll 32 is rotatably supported by the first support 38 fixed to the fixed panel 31 at a position spaced apart frontward from the fixed panel 31. That is, the drive roll 32 is rotatably supported on both sides in the rotational axial direction so that its rotational axis extends along the horizontal direction with respect to the first support 38. Thus, the drive roll 32 is kept parallel to the loading shaft 28 cantilever-supported by the main frame 26. That is, the drive roll 32 is supported by the main frame 26 so as to extend in an orthogonal direction to the film drawing direction (the width direction of the film in the intersecting direction). As separate from the drive roll 32, guide rolls 44, 45, 46 (four in the embodiment) to be described later, which serves to reinforce the first support 38 and can guide winding of the film 12, are disposed between the fixed panel 31 and the sub frame 42 so as to be parallel to the drive roll 32 as shown in FIG. 1.

The four guide rolls 44, 45, 46 include two guide rolls 44, 45 rotatably supported by the fixed panel 31 and the sub frame 42, and two guide rolls 46, 46 which are rotatably supported between the fixed panel 31 and the sub frame 42 and are rotatably supported by a pair of swing arms 48, 48 (only one is shown in FIGS. 1 and 2) spaced apart in the axial direction of the drive roll 32. The guide roll 45 is disposed on the upstream side of the drive roll 32 in the film feed course, and the guide roll 44 is located just below the drive roll 32 and spaced apart therefrom. That is, the film 12 drawn from the film roll 10 is wound on the guide roll 45 through a guide roll 19 disposed on the main frame 26 so as to extend frontward from the main frame 26, and is then guided to the drive roll 32 from the side (more specifically, from obliquely below the left side), and is wound on the outer peripheral surface of the drive roll 32 from the upper side. Then, the film 12 passed through the drive roll 32 is fed out just under so that the film feeding direction becomes the upward and downward direction to be wound on the guide roll 44. The guide roll 19 is provided at such a position that even if the film 12 is drawn out from any of the film rolls 10, 10 at an intermediate position below them in correspondence to the film rolls 10, 10 loaded on the two loading shafts 28, 28, the film 12 can be guided to be wound on the guide roll 19. Then, the position of the guide roll 45 in the film supplying device is set in such a way that the film 12 can be guided to be wounded on the guide roll 45 at a height position where interference between the film 12 fed from the guide roll 19 and the film roll 10 on the right side in FIG. 1 can be avoided.

One ends of the swing arms 48, 48 in the longitudinal direction are rotatably supported on the rotational axis at both ends of the guide roll 44. The sub frame 42 is provided with a locating member 50 (see FIG. 4) in which a plurality of locating slots 50*a* are provided in a circumferential direction of a circle centered on the rotation center of the swing arm 48. Further, an engaging portion (not shown) which is detachably engaged with the locating slot 50*a* is provided on the swing arm 48 on the sub frame side, and changing the position of the locating slot 50*a* engaged with the engaging portion changes the inclination angle of the pair of swing arms 48, 48. The two guide rolls 46, 46 are rotatably disposed on both of the swing arms 48, 48 so that the belt-like film 12 passed through the downstream guide roll 44 is wound on the two guide rolls 46, 46, and then reaches the tube former 14. Both guide rolls 46, 46 are supported by a ball screw mechanism so as to be movable in the longitudinal direction with respect to the swing arms 48, 48. As an operation handle 52, which is disposed in the sub frame 42 and coupled to the ball screw mechanism, is operated to actuate the ball screw mechanism, the guide rolls 46, 46 can be moved and adjusted in the longitudinal direction of the swing arms 48, 48; those components constitute the approaching angle adjusting device 49. Changing the angle of the swing arms 48, 48 and changing the positions of the guide rolls 46, 46 with respect to the swing arms 48, 48 may permit adjustment of the approaching angle of the film 12 approaching the tube former 14 from the guide rolls (approaching angle adjusting roll) 46 located immediately before the tube former 14 according to the sizes of the articles 16 or the like.

Figure 4:
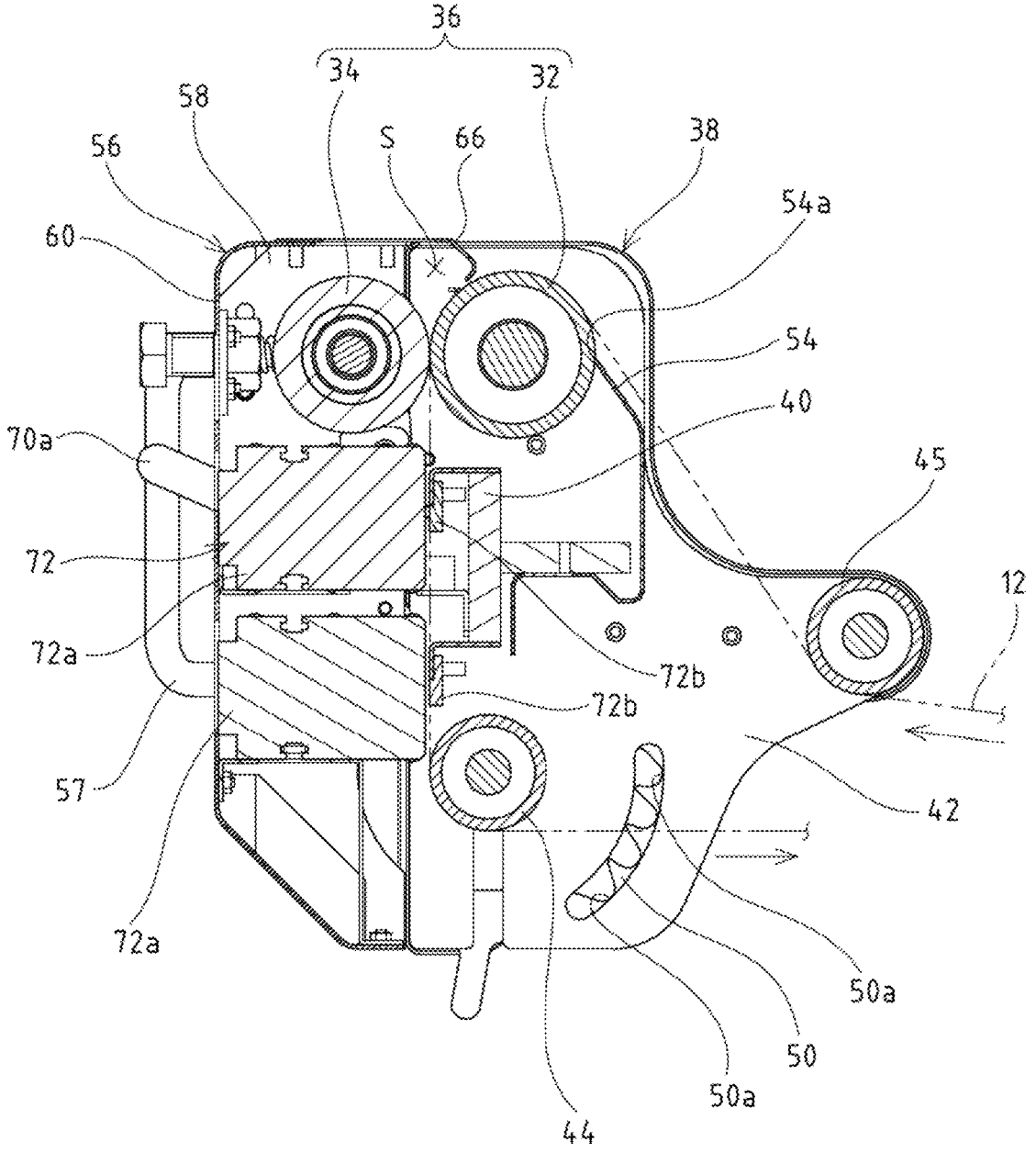
FIG. 4 A schematic cross-sectional view taken along line B-B in FIG. 3 of the film supplying device according to the embodiment.

An arm locking member (not shown) capable of switching between a lockable state and an unlocked state is provided on the first support 38 with the engaging portion of the swing arm 48 being engaged with the locating slot 50*a* of the locating member 50 in response to the forward/reverse rotational operation of an operation lever 53. The arm locking member is configured in such a way that with the arm locking member being unlocked, as the swing arms 48, 48 are lifted up to disengage the engaging portion from the locating slot 50*a*, and selective switching operation to engage with an another locating slot 50*a* is enabled. The locked state that is set by the arm locking member enhances further the rigidity of the first support 38. As shown in FIGS. 2 and 4, the first support 38 is provided with a first cover 54 having a notch 54*a* so as to expose the upper outer peripheral surface of the drive roll 32, so that the first cover 54 does not contact the belt-like film 12 moving in the film feed course extending from the guide roll 45 to the drive roll 32. The first cover 54 is also formed so as not to contact or interfere with the film 12 moving along the film feed course extending from the guide roll 44 to the guide roll 46.

As shown by a solid line in FIG. 3, the second support (second support member) 56 includes a pair of side walls 58, 58 spaced apart in the depth direction, and an outer wall 60 disposed between the side walls 58, 58 to cover sideward portions which are spaced apart from the first support 38 is formed in a box shape whose side facing the first support 38 is dented. The rotational shaft of the driven roll 34 extends in the horizontal direction and is rotatably supported by the side walls 58, 58. The second support 56 is supported, by hinges 61 disposed above and below with respect to the fixed panel 31, so as to be rotatable about a single vertical axis extending in the vertical direction. As a result, the second support 56 rotates along the horizontal plane with the hinges 61 serving as a fulcrum, so that the front side of the second support 56 can open and close with respect to the first support 38. As a result, the second support 56 can horizontally rotate between the sandwiched position (the solid line position in FIG. 3) where the driven roll 34 may approach the drive roll 32 so as to be aligned in the horizontal direction and may hold the film 12, and the retract position (the position indicated by a two-dot chain line in FIG. 3) in which the driven roll 34 is spaced laterally from the drive roll 32. It should be noted that the second support 56 can rotate substantially 90 degrees at which the driven roll 34 is separated from the drive roll 32 with reference to the sandwiched position. The second support 56 is supported by the fixed panel 31 on the side opposite to the side where the film 12 is guided to the drive roll 32 via the guide roll 45 with respect to the first support 38.

A second cover (a cover) 66 is provided on the second support 56 so as to cover the drive roll 32, which is exposed upward from the notch 54*a* of the first cover 54, from the upper side in the sandwiched position. That is, as shown in FIG. 4, the second cover 66 is configured to cover the upper side of the facing region S where the driven roll 34 and the drive roll 32 face each other in the sandwiched position to prevent entry of a foreign matter other than the film from the outside. Further, an operation handle 57 is provided on the second support 56 at the front-side end portion.

The driven roll 34 is rotatably disposed with respect to a support shaft (a rotational shaft) 35 supported between both side walls 58, 58 via an eccentric mechanism. When the support shaft 35 is rotated by the operation lever 68, the driven roll 34 moves away from the drive roll 32 in the sandwiched position by way of the action of the eccentric mechanism, so that the film 12 can be free from the pinching force applied by both rolls 32, 34.

Support locking member 70 which engage with each other to keep the second support 56 in the sandwiched position are respectively provided on the sub frame 42 of the first support 38 and the front-side side wall 58 of the second support 56. The support locking member 70 is configured in such a way that the locked state may be released by operating an unlocking lever 70*a* disposed on the second support 56. As long as the unlocking lever 70*a* is not operated, the locking state of the second support 56 with respect to the first support 38 is maintained by the support locking member 70. Further, the support locking member 70 is configured so that when the second support 56 is rotated to the sandwiched position, the first support 38 and the second support 56 are automatically locked by a claw (not shown) energized by a spring.

As shown in FIG. 4, optical type sensor units 72 including a CIS (Contact Image Sensor) that scans a pattern, a bar code or the like printed at regular intervals on the film 12 are disposed directly below the feed roll 36 on both sides in the film feed course. The sensor unit 72 includes a main body 72*a* disposed on the first support 38 and a reflector 72*b* disposed on the second support 56 so as to face the main body 72*a*, so that the pattern, the bar code or the like can be detected based on the light receiving state from the reflector 72*b* of the light irradiated from the main body 72*a*. The sensor unit 72 is configured so that its length is set longer than the length of the feed roll 36 in the width direction, and the pattern or the like across the entire width of the film 12 can be detected. In the embodiment, the entire width of the film 12 can be detected by shifting and arranging two pairs of main bodies 72*a* and reflectors 72*b* in the lateral direction so that a part of the detection region overlaps.

Next, the operation of the film supplying device according to the embodiment is described. To set the film 12 in the horizontal package making and filling machine, with the support locking member 70 being unlocked, holding the handle 57 provided on the front side of the second support 56, the second support 56 is horizontally rotated about the hinges 61 as a fulcrum. As a result, the driven roll 34 is separated laterally from the drive roll 32 (see FIG. 2). Then, after the belt-like film 12, drawn out from the film roll 10, is wound on the guide roll 45, the belt-like film 12 is wound on the outer peripheral surface of the drive roll 32 exposed from the notch 54*a* of the first cover 54 from the side. Next, after the film 12 wound on the drive roll 32 is wound on the guide roll 44, the film 12 is wound on the two guide rolls 46, 46 and set so as to reach the tube former 14 and the longitudinal seal device 20.

When the second support 56 is rotated to the sandwiched position after the operation of setting the film 12 is completed, the film 12 wound on the drive roll 32 is pinched by the drive roll 32 and the driven roll 34. In addition, the support locking member 70 locks the second support 56 to the first support 38 to keep the second support 56 in the sandwiched position. With the above operation being completed, when the drive roll 32 is rotated by the drive motor 30, the film 12 drawn from the film roll 10 and guided from the side to the drive roll 32 is fed downward from the sandwiched position of both rolls 32, 34 by the feed roll 36.

Since the film supplying device in the embodiment is configured so that the second support 56 can be horizontally rotated about the hinge 61 provided at the back-side end portion of the second support 56, the front side of the driven roll 34 may be largely separated from the drive roll 32, thus facilitating the operation of passing the film 12 between the rolls 32 and 34. That is, even when an operator who is not familiar with the film setting operation draws the film 12 from the film roll 10 to a greater extent, the driven roll 34 can be greatly separated from the drive roll 32, so that the film 12 may be easily passed through the space between the rolls 32 and 34. For this reason, it is possible to suppress the unevenness of the operation times depending on the skills of the operators, and to improve the production efficiency. Further, since the second support 56 is cantilever-supported with respect to the main frame 26, there is not any member that interferes with the operation on the front side of the second support 56 moved to the retract position, and the wearing state of the driven roll 34 made of a rubber material may be easily viewed from the front side. Furthermore, since the first support 38 for supporting the drive roll 32 is fixed and the second support 56 for supporting the driven roll 34 is configured to be movable, it is possible to simplify the coupling structure of the drive roll 32 to the drive motor 30 or the like. In addition, disposing the drive motor 30 on the side of the fixed first support 38 may make it easy to suppress the generation of a vibration and noise which generate when the drive motor 30 is driven.

Further, the film 12 is guided to the drive roll 32 from the side opposite to the side on which the driven roll 34 is disposed, and is wound on the drive roll 32, and then is fed downward, and the facing region S where the drive roll 32 and the driven roll 34 sandwich the film 12 is covered from the upper side by the second cover 66 provided on the second support 56, so that it is possible to prevent a foreign matter from being caught in the facing region S during the packaging operation, thus preventing the occurrence of a packaging failure or the like caused by the entry of a foreign matter. Further, since the second cover 66 covering the facing region S of both rolls 32, 34 is provided on the second support 56, the second cover 66 is separated, together with the second support 56, sideward from the upper side of the drive roll 32. Therefore, the film setting operation is not hindered by the second cover 66, and a proper operability may be guaranteed.

The second support 56 is configured to be rotated in the horizontal direction, so that the operator does not need to support the second support 56 and can easily move the second support 56 with one hand. Since it is unnecessary to hold the second support 56 not to move the second support 56 after the movement of the second support 56 is complete, both hands of the operator are free so that the film setting operation can be easily performed. Further, if the film 12 drawn from the film roll 10 is wound on the drive roll 32 from the upper side, the film 12 may not come off the drive roll 32 even if the grip of the hands on the film 12 is released. This allows the operator to set both hands free to increase operability. The guide roll 45 for guiding the film 12 guided from the guide roll 19 provided at the intermediate position between the two film rolls 10 so as not to interfere with the film rolls 10 is rotatably supported by the fixed panel 31 and the sub frame 42, so that the rigidity of the film supplying device may be enhanced (strengthened), leading to simplification of the configuration. Furthermore, at a height position (between the film roll 10 and the tube former 14) where the film 12 guided from the guide roll 45 does not interfere with the film feed course between the guide roll 19 and the guide roll 45 by setting the approaching angle adjusting device 49 between the fixed panel 31 and the sub frame 42 so as to adjust the position of the approaching angle adjusting roll 46 according to the kind of the packaged product or the like, the rigidity can be increased, thereby simplifying the configuration.

(Modifications)

The present invention is not limited to the configuration of the embodiment, and may be modified, for example, as follows. In addition, the present invention is not limited to the following modifications, and various configurations may be adopted for the configurations described with reference to the embodiment within the scope and spirit of the subject matter of the invention.

(1) Although the second support 56 is configured to be supported by the fixed panel 31 of the main frame 26 by the hinge 61, the second support 56 may be directly supported on the main frame 26 or the second support 56 may be rotatably supported on the first support 38 fixed to the main frame 26. That is, it is possible to adopt various support structures for supporting the second support 56 to the main frame 26 directly, or indirectly via a separate member.

(2) It is possible to adopt such a configuration that instead of the hinge 61, a rail or the like may be used to movably support the second support 56 to the fixed panel 31 or the main frame 26 so that as the driven roll 34 is moved closer to or away from the drive roll 32, the one end side (front side) of the feed roll 36 which intersects the film drawing direction is widely opened.

(3) The configuration may be adapted to the configuration that feeds the film 12 from the lower side of the feed roll 36 to the upper side.

(4) The support locking member 70 that keeps the second support 56 in the sandwiched position may be configured to lock the second support 56 with respect to the main frame 26.

(5) The driven roll 34 is not limited to the configuration in which the driven roll 34 rotates with respect to the support shaft 35, but the support shaft integrally provided with the driven roll 34 may be rotatably supported with respect to the second support 56 so that the driven roll 34 may rotate together with the support shaft.

(6) The first support (first support member) 38 may take a configuration in which the drive roll 32 may be rotatably supported between a pair of side walls provided at both ends of the reinforcing stay 40, with one side wall being fixed to the main frame 26, instead of the configuration of supporting one axial end of the drive roll 32 with the main frame 26.

(7) The supply conveyor is not indispensable as a horizontal package making and filling machine.

(8) The configuration may be applied to a horizontal package making and filling machine that forms the overlapped portion of both ends of the film 12, fed to the tube former 14 from a position lower than the tube former 14, on the upper portion of the tubular film, or a film supplying device of a horizontal package making and filling machine that forms the overlapped portion on a side portion of the tubular film. The horizontal package making and filling machine in which the overlapped portion is formed on the side portion of the tubular film may take a configuration in which the entire structure shown in FIG. 2 including the film supplying device is rotated 90 degrees so that the free end side of the loading shaft 28 faces upward. Further, it is possible to adopt a configuration in which the entire structure of FIG. 2 except the approaching angle adjusting device 49 is rotated by 90 degrees. That is, the drive roll (drive side rotation member) and the driven roll (driven side rotation member) of the film supplying device may take any configuration as long as the driven roll (driven side rotation member) may be aligned with the side of the drive roll (drive side rotation member) to be able to pinch the film in the sandwiched position, and the driven roll (driven side rotation member) may be separated from the drive roll (drive side rotation member) in the retract position.

(9) It is possible to adopt such a configuration that the film 12 may be sandwiched by a pair of belts (drive side and driven side rotation member) or the like, which are driven to run, instead of the drive roll 32 and the driven roll 34, to draw the film 12 from the film roll 10.

(10) The approaching angle adjusting device 49 is not limited to the configuration in which the approaching angle adjusting device 49 is provided on the first support 38 (film supplying device), and may take a configuration in which the approaching angle adjusting device 49 is separately provided on the main frame 26 or the like on the downstream side of the film supplying device.

DESCRIPTION OF REFERENCE NUMERALS

10 film roll
12 film
14 tube former
26 main frame (main body)
32 drive roll (drive side rotation member)
34 driven roll (driven side rotation member)
38 first support (first support member)
49 approaching angle adjusting device
56 second support (second support member)
66 second cover part (cover part)
S facing region

What is claimed is:

1. A film supplying device in a horizontal package making and filling machine provided with an approaching angle adjusting device adjusting an approaching angle of a film toward a tube former, the approaching angle adjusting device being provided in a film feed course between a film roll and the tube former, the film supplying device comprising:

a drive side rotation member provided in the film feed course between the film roll and the approaching angle adjusting device, and extending along a width direction of the film;

a driven side rotation member that rotates responsive to the drive side rotation member with the film being positioned between the drive side rotation member and the driven side rotation member;

a first support member fixed to a main body and supporting the drive side rotation member rotatably on both sides in a rotational axial direction of the drive side rotation member;

a second support member rotatably supporting the driven side rotation member on both sides in the rotational axial direction of the driven side rotation member, and a cover member provided on the second support member, a portion of the cover member directed in a vicinity of the drive side rotation member by covering a facing region where the drive side rotation member and the driven side rotation member are configured to contact each other while the second support member is in a sandwiched position;

wherein the second support member is supported on the main body in such a way as to be movable between the sandwiched position in which the driven side rotation member approaches the drive side rotation member to be aligned therewith to sandwich the film, and a retract position spaced apart from the sandwiched position, and the drive side rotation member that moves the second support member to the sandwiched position to sandwich the film with the driven side rotation member is rotated to draw the film downstream from the film roll; and wherein a support shaft of the driven side rotation member is supported between two side facing walls, whereby rotating an operation lever mounted on one end of the support shaft moves the driven side rotation member away from the drive side rotation member.

2. The film supplying device according to claim 1, wherein the drive side rotation member is supported on the first support member so that a rotational axis of the drive side rotation member extends along a horizontal direction, and the driven side rotation member is supported on the second support member so that the rotational axis of the driven side rotation member extends along the horizontal direction, and the second support member is supported on the main body so as to be horizontally movable between the sandwiched position in which the driven side rotation member is horizontally arranged with the drive side rotation member, and the retract position.

3. The film supplying device according to claim 2, wherein the film sandwiched by the drive side rotation member and the driven side rotation member is fed out downstream.

4. The film supplying device according to claim 1, wherein:

the second support member comprises:

a pair of sidewalls that rotationally support both sides of the driven side rotation member; and an outer wall extending between the pair of sidewalls to cover the driven side rotation member; and the cover extending from a first end of the outer wall between the pair of sidewalls.

5. A film supplying device in a horizontal package making and filling machine, the film supplying device comprising:

a main body;

a first support coupled to the main body, the first support includes:

a pair of opposing sidewalls; and a support shaft that extends between the pair of opposing sidewalls;

a second support moveably coupled to the main body relative to the first support;

a first roller rotatably coupled to the first support and extending along a first axis that is configured to align with a width direction of a film moving on a film feed course;

a second roller rotatably coupled to the second support and extending along a second axis, the second roller positioned adjacent to the first roller such that the film feed course passes between the first roller and the second roller; and an operation lever mounted a first end of the support shaft, the operation lever configured to be actuated such that actuation of the operation lever moves the first roller away from the second roller;

wherein:

the second support is movable between:

a first position in which the second roller contacts the first roller and in which the first axis of the first roller and the second axis of the second roller are parallel; and a second position in which the second roller does not contact the first roller and in which the second axis of the second roller is angularly disposed relative to the first axis of the first roller;

the first roller is coupled to and rotatable with the support shaft; and the first roller is configured to be rotatably driven by a motor to draw the film downstream from a film roll.

6. The film supplying device according to claim 5, further comprising:

an approaching angle adjusting device configured to adjust an approaching angle of the film, the approaching angle adjusting device positioned in the film feed course between the film roll and a tube former; and wherein the first and second roller are positioned between the film roll and the approaching angle adjusting device.

7. The film supplying device according to claim 5, further comprising:

a cover coupled to the second support; and wherein while the second support is in the first position, the cover extends parallel to the first axis and overlies at least a portion of the first roller to cover a facing region of both the first and second roller.

8. The film supplying device according to claim 7, wherein:

the second support includes:

a pair of opposing sidewalls;

an outer wall that extends between the pair of opposing sidewalls; and the cover extends:

from a first end of the outer wall at a first angle; and between the pair of opposing sidewalls.

9. The film supplying device according to claim 8, wherein the cover comprises a portion that is curved toward the outer wall.

10. The film supplying device according to claim 5, wherein:

the second support is rotatably coupled to the main body; and while the second support is in the second position, the second axis of the second roller is angularly disposed relative to the first axis of the first roller.

11. The film supplying device according to claim 5, wherein:

the first roller is supported on the first support so that the first axis of the first roller extends along a horizontal direction, and the second roller is supported on the second support so that the second axis of the second roller extends along the horizontal direction while the second support is in the first position; and the second support is supported on a main body so as to be horizontally movable between the first position and the second position.

12. The film supplying device according to claim 5, wherein while the second support is in the second position, the film extends from the film roll to an approaching angle adjusting device along the film feed course and a portion of the film is positioned between the first roller and the second roller.

13. The film supplying device according to claim 5, wherein the second roller is configured to be rotated by contact with the first roller.

* * * * *